United States Patent [19]

Smith

[11] 4,161,360

[45] Jul. 17, 1979

[54] LIQUID DEVELOPMENT APPARATUS

[75] Inventor: Kenneth W. Smith, Welwyn Garden City, England

[73] Assignee: Xerox Corporation, Stamford, Conn.

[21] Appl. No.: 837,137

[22] Filed: Sep. 28, 1977

[30] Foreign Application Priority Data

Dec. 31, 1976 [GB] United Kingdom ..... 54465/76

[51] Int. Cl.[2] ..... G03G 15/00

[52] U.S. Cl. ..... 355/10; 96/1 LY; 118/651; 118/661

[58] Field of Search ..... 355/10, 4; 118/DIG. 23, 118/651, 661; 427/15-17; 96/1 LY, 1.2

[56] References Cited

U.S. PATENT DOCUMENTS

| | | | |
|---|---|---|---|
| 3,256,855 | 6/1966 | Oliphant | 118/DIG. 23 |
| 3,355,288 | 11/1967 | Matkan | 118/651 X |
| 3,667,428 | 6/1972 | Smith | 355/10 X |
| 3,830,199 | 8/1974 | Saito et al. | 118/661 |
| 3,978,817 | 9/1976 | Hauser | 118/661 |
| 4,024,838 | 3/1977 | Horie | 355/10 |
| 4,068,938 | 1/1978 | Robertson | 355/4 |

*Primary Examiner*—R. L. Moses

*Attorney, Agent, or Firm*—Harvey M. Brownrout; Clarence A. Green; Ronald F. Chapuran

[57] ABSTRACT

Electrostatographic imaging apparatus including a development apparatus for the liquid development of electrostatic latent images on an imaging surface, the development apparatus comprising first and second developer applicators arranged for successive application of developer liquid to the surface, the first and second applicators having retaining recesses for developer liquid, and the recesses of the first and second applicators being of relatively high and low frequencies, respectively.

7 Claims, 1 Drawing Figure

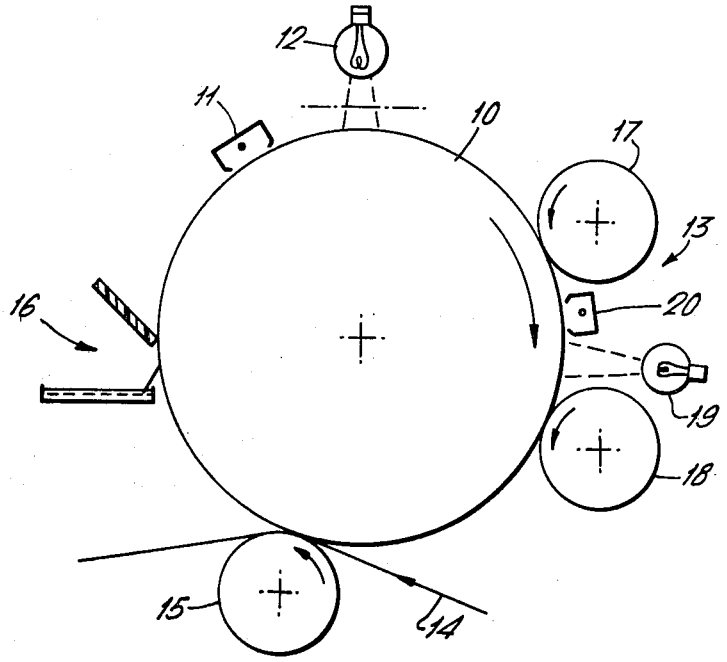
12
11
10
17
13
16
20
19
18
15
14

LIQUID DEVELOPMENT APPARATUS

BACKGROUND OF THE INVENTION

This invention relates to an electrostatographic imaging apparatus, and is particularly concerned with a development apparatus for the liquid development of electrostatic latent images.

PRIOR ART STATEMENT

In a liquid development electrostatographic imaging apparatus, electrostatic latent images are formed on a suitable imaging surface, which is either an insulating surface, or, in an electrophotographic apparatus, is a photoconductor. These electrostatic latent images are then developed by means of a developer liquid.

A typical method of liquid development for electrostatic latent images is that described by R. W. Gundlach in U.S. Pat. No. 3,084,043. In this method, an electrostatic latent image is developed, i.e., made visible, by presenting to the imaging surface a liquid developer on the surface of a developer dispensing member, typically a roller having a plurality of raised portions or "lands" defining a substantially regular patterned surface and a plurality of depressed portions of the developer dispensing member contain liquid developer which is maintained out of contact with the electrostatographic imaging surface. Development is achieved by moving the developer dispensing member loaded with liquid developer in the depressed portions into contact with the imaging surface. The liquid developer is believed to be attracted from the charged areas only. The developer liquid may be pigmented or dyed. Practical systems using this method usually employ a reusable, cycling, imaging surface. In these systems a photoconductor such as selenium or a selenium alloy forms the surface of a drum or an endless flexible belt and is charged, exposed to a light and shadow image and developed by bringing the image bearing surface into developing configuration with an applicator containing developing quantities of liquid developer thereon, as just described. The liquid developer is transferred to the imaging surface in image configuration. Thereafter the developer pattern on the imaging surface is transferred to copy paper where the liquid developer may be absorbed by the paper to form a permanent print.

Although liquid development electrostatographic apparatuses of the kind just described produce copies which are satisfactory for many purposes, it is sometimes desirable to produce copies of somewhat higher quality, and it is an object of the present invention to provide an apparatus capable of making such copies.

SUMMARY OF THE INVENTION

According to the present invention, there is provided an electrostatographic imaging apparatus including a development apparatus for the liquid development of electrostatic latent images on an imaging surface, the development apparatus comprising first and second developer applicators arranged for successive application of developer liquid to the surface, the first and second applicators having retaining recesses for developer liquid and the recesses of the first and second applicators being of relatively high and low frequencies, respectively.

Typically, the developer applicators are grooved rollers, and in these circumstances, the grooves of the two rollers are inclined at different angles to their respective roller axes.

BRIEF DESCRIPTION OF THE DRAWINGS

An apparatus in accordance with the invention will now be described, by way of example, with reference to the accompanying drawing, which is a diagrammatic cross-section of an electrostatic imaging apparatus incorporating the apparatus of the invention.

DETAILED DESCRIPTION OF THE PREFERRED EMBODIMENT

Referring to the drawing, an electrostatic latent image is placed on the imaging surface 10 illustrated as a rotating cylindrical drum photoconductor such as a selenium drum by uniformly placing a positive charge on the drum by charging means 11 and then exposing the charged surface to a light-and-shadow image through exposure means 12. The electrostatic latent image is developed at developing station 13 and the developer on the imaging surface in image configuration is transferred to a receiver sheet 14 such as ordinary paper which is moved through the transfer zone in contact with the drum at the same rate and in the same direction as the periphery of the drum. The paper to which the developed image is transferred is held in transfer position by idler 15. The residual developer present on the electrostatographic imaging member is cleaned from the imaging member at a cleaning station 16.

At the developing station 13, the development apparatus of the invention includes two developer applicators 17 and 18, which will be referred to as first and second applicators in the order in which they contact the surface 10 in operation. The applicators, as shown in the drawing, are preferably rollers. As mentioned earlier, one form of applicator which is used in electrostatographic liquid development devices is one having a large number of small, closely-spaced recesses for containing liquid developer. One of the most convenient embodiments of such an applicator is a grooved roller, and in the present case, the preferred applicators 17 and 18 are grooved rollers. The grooves in the first roller 17 are of higher frequency (i.e., are closer together) than those in the second roller 18. In this way, at the first roller 17 the charge pattern being developed is developed with high fidelity, but a low volume of liquid developer. At the second roller 18, the already-developed image is developed again, this time with the lower-frequency applicator, whereby the depth of the liquid developer is increased to an acceptable level, while the high fidelity outline of the image is maintained.

The second development may be mechanical rather then electrostatic and to this end a lamp 19 may be provided between the first and second rollers 17 and 18 for flood illuminating the imaging surface 10 so as to make the photoconductor conductive and, therefore, incapable of supporting electrostatic charges. Alternatively, the imaging surface and the developed image on it may first be charged overall by a corona charging device 20, and then flood illuminated by lamp 19. In this way some charge may remain on the liquid developer to assist the second development, but the imaging surface itself is free of charge, thus reducing the incidence of developed background due to previously undeveloped charges.

In order to reduce Moire' effects produced by double development with grooved rollers, the grooves on the two rollers may be at different angles to their respective roller axes.

The patent referred to specifically in this application is intended to be incorporated by reference into the description.

It is apparent that there has been provided in accordance with this invention a liquid development apparatus which fully satisfies the objects, means and advantages set forth hereinbefore. While the invention has been described in conjunction with specific embodiments therefor, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. Electrostatographic imaging apparatus including a development apparatus for the liquid development of electrostatic latent images on an imaging surface, the development apparatus comprising first and second developer applicators arranged for successive application of developer liquid to the surface, the first and second applicators having retaining recesses for developer liquid, and the recesses of the first and second applicators being of relatively high and low frequencies, respectively, for enhanced developed image quality.

2. The apparatus of claim 1, wherein said second developer applicator is arranged to perform mechanical development with a relatively high volume of developer liquid.

3. The apparatus of claim 2, including means for removing electrical charges from the imaging surface between the first and second developer applicators.

4. The apparatus of claim 3, wherein the imaging surface is a photoconductor and said means for removing electrical charges comprises means for flood illuminating the imaging surface.

5. The apparatus of claim 1, including means for electrically charging the imaging surface and the developed image thereon between the first and second applicators, and means for removing electrical charge from the imaging surface.

6. The apparatus of any one of claim 1, wherein the first and second applicators are grooved rollers.

7. The apparatus of claim 6, wherein the grooves on the first and second applicator rollers are inclined at different angles to their respective roller axes.

* * * * *